US005373774A

United States Patent [19]

Akbar

[11] Patent Number: 5,373,774

[45] Date of Patent: Dec. 20, 1994

[54] PLOW FOR ARMORED VEHICLE

[76] Inventor: Habib Akbar, 11/6 Allauddin Road, Lahore Cantt, Pakistan

[21] Appl. No.: 147,124

[22] Filed: Nov. 3, 1993

[51] Int. Cl.[5] ..... F41H 11/12

[52] U.S. Cl. ..... 89/1.13; 171/141

[58] Field of Search ..... 89/1.13; 171/141; 172/832

[56] References Cited

U.S. PATENT DOCUMENTS

| | | | |
|---|---|---|---|
| 2,718,109 | 9/1955 | Hintz et al. | 171/141 |
| 4,467,694 | 8/1984 | Azulai et al. | 171/141 |
| 4,491,053 | 1/1985 | Bar-Nefy et al. | 89/1.13 |
| 4,590,844 | 5/1986 | Bar-Nefy et al. | 89/1.13 |
| 4,690,030 | 9/1987 | Bar-Nefy et al. | 171/141 |
| 4,919,034 | 4/1990 | Firth | 89/1.13 |
| 4,938,114 | 7/1990 | Matthews et al. | 89/1.13 |
| 4,967,850 | 11/1990 | Bargfrede et al. | 89/1.13 |
| 5,046,565 | 9/1991 | Purcell | 89/1.13 |
| 5,189,243 | 2/1993 | Hambric | 89/1.13 |
| 5,198,608 | 3/1993 | Cahill et al. | 89/1.13 |

*Primary Examiner*—David Brown

*Attorney, Agent, or Firm*—Hill, Steadman & Simpson

[57] ABSTRACT

A lightweight mine extracting plow is provided that can be mounted on any type of armored vehicle to enable the vehicle to cross minefields in an attack formation or to assist the armored vehicle in escaping from scattered minefields, either laid by air or by artillery, by removing obstacles, such as mines, from all areas of land. The plow has tines which penetrate the land to extricate the mines. Blades are shaped to dispose the mines sideways out of the path of the tracks of the vehicle. A folding skid device controls articulation of the plow over ground undulations and extends forward to assist in bridging ditches. The skid has a device which automatically positions it in front of the plow and overturns it into a pre-operation mode. A mechanical lifting device is operable by reversing the vehicle to lift the plow out of the ground. Thereafter, the device automatically reverts to its pre-operation mode. A locking device holds the plow in its pre-operation mode and allows it to drop to the ground when desired. A sliding bracket arrangement is provided such that the plow can be discarded by reversing the carrying vehicle.

22 Claims, 5 Drawing Sheets

42
44
40
46
34
36
30
52
106
104
54
108
110
114
102
126
42
124
128
44
120
40
50
118
172
112
86
86
46
30
56
142
122
58
140
60
138
130
132
136
134
168
22
148
32
16
152
144
146
156
150
154
12

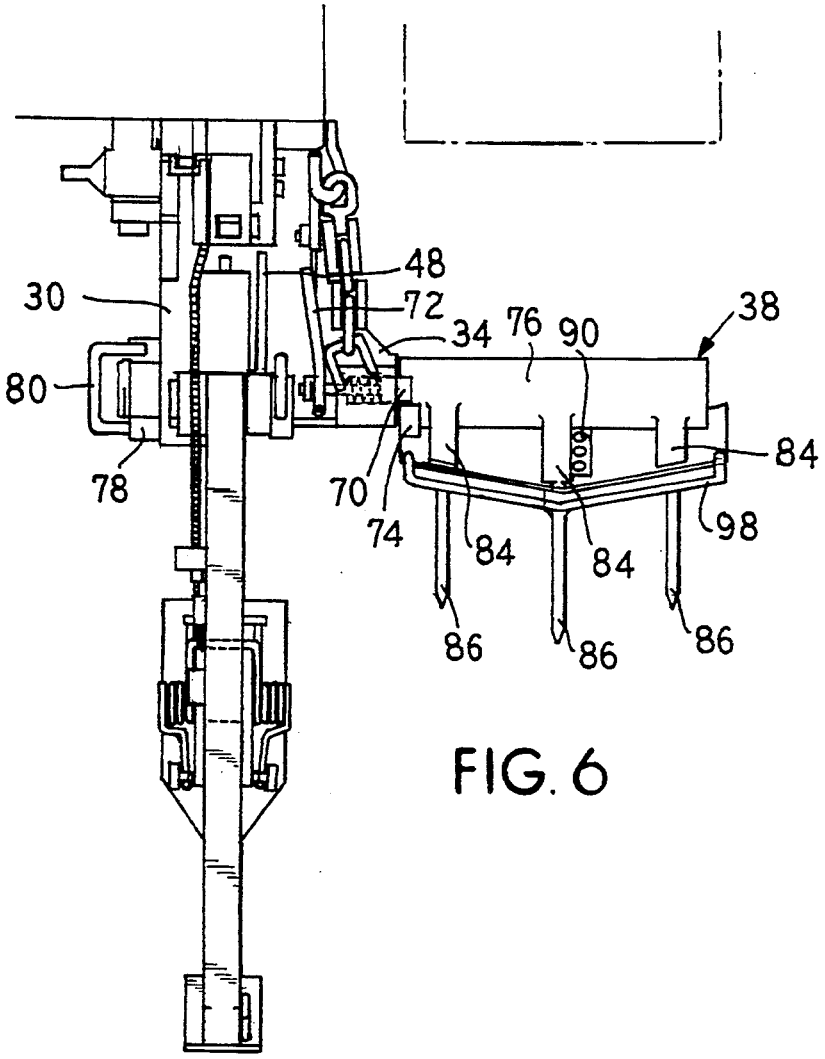
FIG. 6
FIG. 7
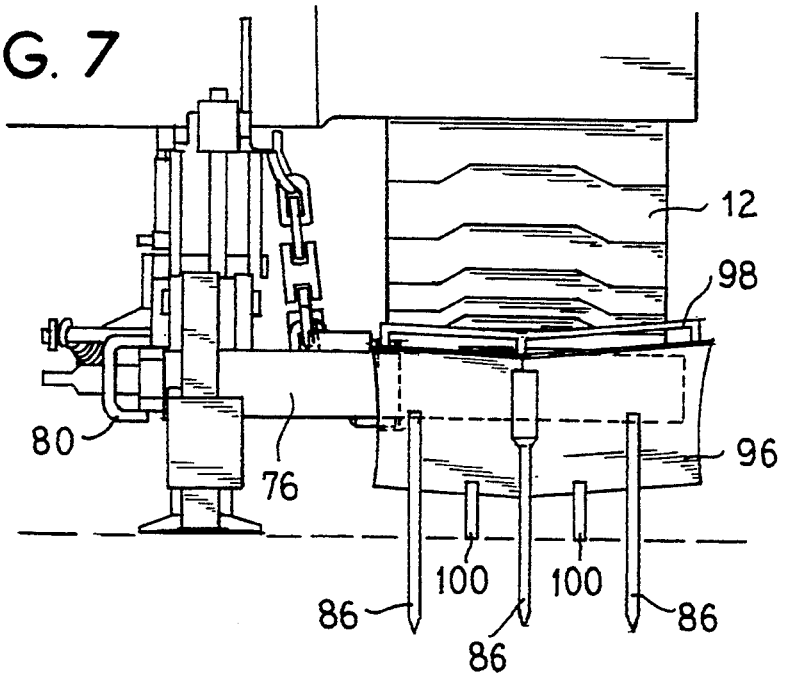

PLOW FOR ARMORED VEHICLE

BACKGROUND OF THE INVENTION

The present invention generally relates to a plow. More specifically, the invention relates to a plow for attachment to vehicle for removing objects, such as mines, from an area of land.

Of course, mine extracting plows have been generally known since approximately World War II. The plows are designed to provide safe lanes through mine fields to enable other vehicles to follow through in single file behind the plow. Mines are typically scattered in mine fields by the enemy. Typically, mines are dropped from the air or otherwise placed by artillery. The mines are scattered randomly or in a pattern across the mine field by the enemy to delay any attack or forwarding of troops.

This delay is accomplished since mines must be removed before a vehicle can successfully pass through the mine field. A known type of plow for removing mines is referred to as a "breaching plow." Such a plow must breach the mine field before any other armored vehicle, such as tanks, can also be used. A breaching plow is typically an individual armored vehicle which is only suitable for plowing.

However, before a breaching plow can be employed, the enemy from the far side of the mine field must be dislodged to prevent direct anti-tank fire on the equipment. To do so, a bridge head is made across the mine field by troops devoid of armored vehicles thereby reducing their fighting capability. Before the bridge head operation can be launched, it is also necessary to concentrate an attacking force on the home side of the mine field. These concentrations of the attacking force invite air and artillery bombardment and, therefore, much damage results even before the actual attack is started.

Further, the breaching plow is also very heavy in weight and bulky making the plow cumbersome to handle. In addition, the breaching plow, during operation, plows large quantities of earth and covers the extracted mines. This makes the mines difficult for troops following the plow to identify the mines and also difficult for engineering troops to locate the mines.

Further, breaching plows are similar to bulldozers in that powerful engines are required to push the vehicle having such plows. Furthermore, the bulldozing effect only allows the plow to move at a very slow speed (approximately three to six miles per hour) during operation. As a result, the plows are easy targets for enemy anti-tank fire or air action.

The breaching plow cannot be mounted on any light armored vehicles as the weight of such vehicles is insufficient to anchor the treads during operation thereby causing them to slip. When mounted on an armored vehicle, the breaching plow extends substantially in front of the plow. This particular arrangement interferes with the cross country capability of the vehicles, particularly, the crossing of ditches, trenches and the like, since the plow tends to dig into the ground when the front end of the vehicle dips into the ditch or when getting off a landing craft on a beach head.

Furthermore, the breaching plows are not shaped with the configuration of the vehicle restricting the ability of the driver to seek cover in woods, clumps of trees, and the like. Misjudgment by the driver can, therefore, result in damage to the plow.

A further problem associated with breaching plows is such plows are at least partially electrically controlled. That is, power for the breaching plows is drawn from the vehicle to which it is attached. In addition, sophisticated hydraulic components located outside the vehicle are also operated by the power of the vehicle. Such systems are prone to damage under battle field conditions, particularly in a nuclear environment. Breaching plows are prone to damage or breakdown owing to underground obstacles like immoveable rocks and roots.

In view of the aforesaid, breaching plows are only mounted on a limited number of vehicles to make safe lanes for other vehicles to follow one behind the other. This makes the columns easy targets for air and ground action.

A need, therefore, exists for an improved plow which can be called an assault plow for removing obstacles, such as mines, from an area of land wherein the plow can be attached to any vehicle so that armored formations can assault across a minefield in attack formation with each vehicle making its own way through the minefield rather than following one behind the other. This is necessary for restoring to armor its basic characteristics of fire power mobility and shock and for allowing the armor commander complete flexibility to maneuver through a mine infested area without having to launch a bridge head operation or unduly concentrate troops. This is only possible if the plow is reduced in size and so constructed as to blend completely with the configuration of the armored vehicle so that normal freedom of operation of the vehicle is not effected. Further, the plow must continue to function and not get damaged or break down when striking an underground immoveable obstacle and not reduce the speed of the attack.

SUMMARY OF THE INVENTION

The present invention provides a plow for attachment to any armored vehicle. More specifically, the attached plow removes obstacles, such as mines, from a mine field during battle. Further, the present invention provides at least one member secured to a tracking member for maintaining penetration of the at least one tine member in the ground, sand or the like.

To this end, in an embodiment, the present invention provides an apparatus connected to a vehicle for removing mines in a path of the treads of the vehicle in an operational mode from an area of land. The apparatus comprises at least one member at least partially penetrating into the land in the operational mode. A tracking member substantially follows a surface of the land in the operational mode and is constructed and arranged to substantially maintain the penetration of the at least one member into the land wherein the vehicle pushes the tracking member and the at least one member across at least a portion of the land to remove the mines.

In an embodiment, the at least one member is a tine angularly displaced with respect to the land.

In an embodiment, the tracking member and the at least one member are mechanically rotatable into a stowed position which blends the plow with the configuration of the armored vehicle so as not to affect its ditch crossing capabilities according to vehicle specification.

In an embodiment, at least one member is mechanically rotatable into a pre-operational position.

In an embodiment, at least one member is a rotatable tine having a plurality of blades.

In an embodiment, the apparatus further comprises a deflector constructed and arranged to prevent the mines from situating in the path of the treads of the vehicle after removal from the land.

In an embodiment, the apparatus further comprises means for inverting the at least one member and the tracking member into a pre-operational mode such that the apparatus cannot interfere with movement of the vehicle.

In an embodiment, a plowing apparatus is provided for attachment to a vehicle for removing mines from an area of land in a path of the treads of the vehicle. The plowing apparatus comprises a plurality of plowing members, each of the plurality of plowing members including a plurality of tines for penetrating the land. A plurality of tracking members correspond to the plurality of plowing members wherein each of the plurality of tracking members follows undulation in the land and are constructed and arranged to substantially maintain a depth of penetration of the land by the plurality of tracking members.

In an embodiment, the plowing apparatus further comprises an adjusting means for varying the depth of the penetration of each of the plurality of tines.

In an embodiment, the plowing apparatus further comprises a handle for releasing the apparatus from a pre-operational mode to the land.

In an embodiment, each of the plurality of tracking members of the plowing apparatus further comprises a skid substantially following the undulation of the land. A skid arm is constructed and arranged to adjust the associated plurality of tines as the skid crosses the undulation.

In an embodiment, the plurality of tines are angled with respect to the land and have a horizontal displacement between each of the plurality of tines.

In an embodiment, the plurality of tines are rotatable and each of the rotatable tines includes a plurality of tines which rotate on striking an underground obstacle, replacing its working portion with a second tine automatically.

In an embodiment, the vehicle is armored having two tracks for moving the vehicle across the land wherein the plurality of plowing members is two and are immediately preceding the tracks of the vehicle in an operational mode.

In an embodiment, a method is provided for removing mines from an area of land. The method comprises the steps of: providing a vehicle for traveling across at least a portion of the area of land; securing a plurality of land penetrating members to the vehicle such that the land penetrating members extend in front of the vehicle; providing at least one tracking member for substantially maintaining a depth of penetration of the plurality of land penetrating members; and moving the vehicle across the portion of the area of the land.

In an embodiment, a flexible spring and rod arrangement explodes tilt rod mines ahead of the armored vehicles that are located between the two treads.

In an embodiment, the method further comprises the step of stowing the plurality of land penetrating members in a position to blend with the front configuration of the armored vehicle so as not to interfere with operation of the vehicle particularly the specified ditch crossing capability.

In an embodiment, the method further comprises the step of mechanically positioning at least the plurality of land penetrating members between a stowed position, a pre-operational position and an operational position.

In an embodiment, the method further comprises the step of mechanically positioning the at least one tracking member.

It is, therefore, an advantage of the present invention to provide an apparatus that is both small and light which does not encumber the vehicle to which the apparatus is attached or interfere in its primary role and which can be mounted on each and every armored vehicle so that armored units can assault in attack formation with each vehicle making its own path through the mine infested area.

Further, an advantage of the present invention is to provide an apparatus and a method for extracting mines from an area of land without uncovering and piling excessive amounts of earth on the sides.

Yet another advantage of the present invention is to provide an apparatus and a method for extracting obstacles, such as mines, making the extracted mines clearly visible to others.

A further advantage of the present invention is that it instantly overcomes underground immoveable obstacles without causing damage to the digging members or the apparatus for bringing the vehicle to a halt.

A still further advantage of the present invention is to provide an apparatus and a method for removing obstacles or removing mines across an area of land requiring significantly less power than conventional apparatus.

And, a further advantage of the present invention is to provide a vehicle having an apparatus for removing mines which can move through a mine field at tactical speeds.

The speed of movement reduces the effect of enemy anti-tank fire or air strike action.

Yet another advantage of the present invention is to provide an apparatus for removing mines capable of mounting on any type of vehicle including vehicles with low-powered engines.

Another advantage of the present invention is to provide an apparatus shaped to the configuration of the body of a vehicle to which the apparatus is attached in a stowed mode for crossing obstacles. For this purpose, the apparatus is mounted to be clear of the sloping part of a track of the vehicle which assists the vehicle in climbing. Thus, the specified ditch crossing capability of the vehicle is not disturbed.

Further, an advantage of the present invention is to provide an apparatus and a method which does not restrict cross country movement allowing any vehicle to cross ditches, trenches and the like without interference of the apparatus.

A still further advantage of the present invention is to provide an apparatus and a method for removing mines which does not restrict vision or judgment of a driver of the a vehicle to which the apparatus is attached thereby allowing the driver to move the vehicle through areas without fear of damaging the apparatus.

Still further, an advantage of the present invention is to provide an apparatus and a method for removing mines which does not draw power from the vehicle to which the apparatus is attached.

Yet another advantage of the present invention is to provide an apparatus and a method for removing mines which uses simplistic systems for operating the same and is ruggedly designed so as not to malfunction under battle field conditions.

Additional features and advantages of the present invention are described in, and will be apparent from the detailed description of the presently preferred embodiments and from the drawings.

BRIEF DESCRIPTION OF THE DRAWINGS

FIG. 6 illustrates a plan view of a portion of an embodiment of the plow of the present invention in an operating mode.

FIG. 7 illustrates a front view of a portion of an embodiment of the plow of the present invention in an operating mode.

DETAILED DESCRIPTION OF THE PRESENTLY PREFERRED EMBODIMENTS

The present invention relates to a plow for connecting to a vehicle. More specifically, the present invention relates to a plow for connection to an armored vehicle with the capability of traveling through an area of land removing obstacles, such as mines, therefrom.

Figure 1:
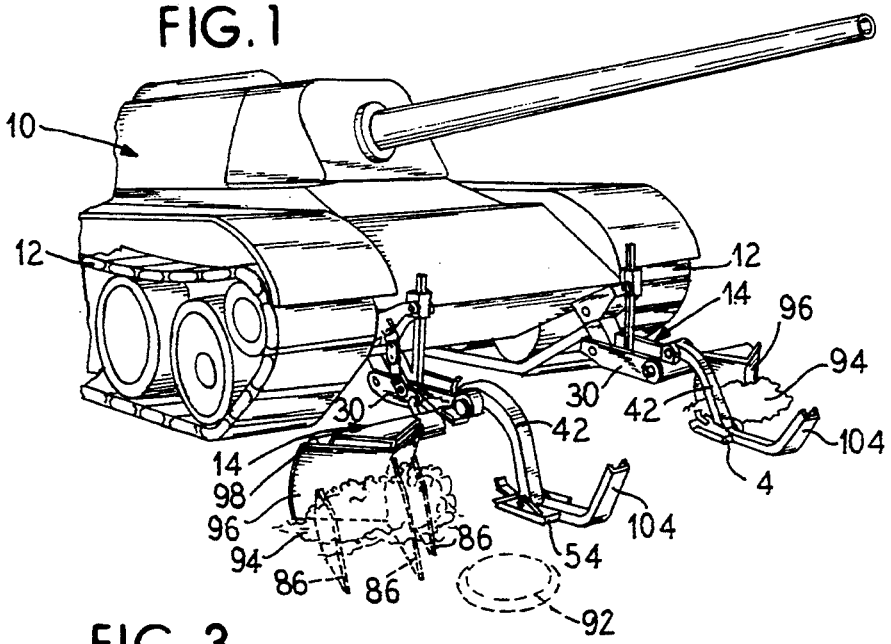
FIG. 1 illustrates a perspective view of an armored vehicle having an embodiment of a plow of the present invention.

Referring now to the figures wherein like numerals designate like parts, FIG. 1 illustrates an armored vehicle generally shown at 10. The armored vehicle 10 includes a pair of rotating tracks 12. The front portions of the tracks 12 are sloped at an angle for the armored vehicle 10 to climb through ditches, trenches and the like. Attached at the front end of the armored vehicle 10 is a pair of plows generally illustrated at 14. Each of the plows 14 consists of a number of associated parts which are more clearly illustrated in FIG. 2.

One part generally illustrated at 16 is a sliding bracket. The sliding bracket 16 mounts the plow 14 onto the vehicle 10. It should be understood that only a single plow of the two plow system as illustrated in FIG. 1 will be referred to, but each of the plows 14 are identically configured and attached to the vehicle 10. A female part 18 of the sliding bracket 16 is welded onto a portion of the body of the vehicle 10. A male part is then slid onto the female part 18. A spring-loaded locking catch 20 automatically engages with a lower part of the female part 18 to hold the plow 14 in position.

A main beam 22 of the sliding bracket 16 pivots at a point generally designated at 24. The main beam 22 is pivoted at the point 24 toward the sliding bracket 16 at its upper end. In an operating mode of the plow 14, the main beam 22 rests on a stopper 26. At its lower end, the main beam 22 is pivoted at another point generally designated at 28. The main beam 22 pivots at the point 28 with respect to the body 30.

A chain 32 connects the sliding bracket 16 to the body 30. The chain 32 limits the freedom of movement of the body 30. This is particularly crucial when the vehicle 10 is crossing through ditches, trenches and the like. The chain 32 prevents any portion of the plows 14 from falling in the ditches.

Figures 4, 5:
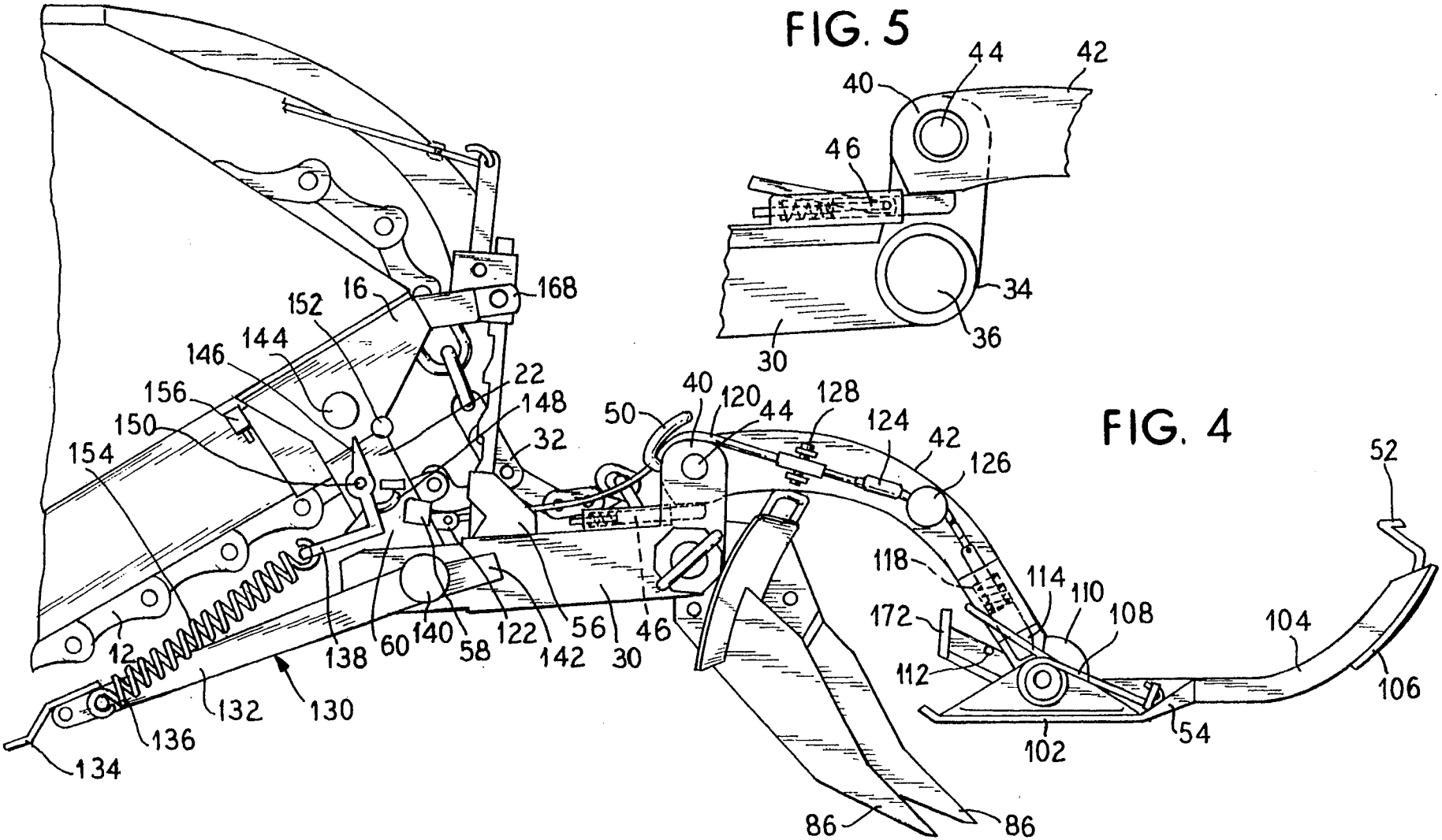
FIG. 4 illustrates a partial side view of the component of an embodiment of the plow of the present invention.
FIG. 5 illustrates a partial and exploded view of a component of an embodiment of the plow of the present invention as shown in FIG. 4.

The body 30 of the plow 14 is pivoted at the point 28 on the main beam 22. At an opposite end from the point 28, the body 30 includes a bush 34. The bush 34 houses a shaft 36 of a tine assembly 38. At a front end of the body 30 are brackets 40 on which a skid arm 42 is mounted. The skid arm 42 pivots at a point 44 of the bracket 40 on the body 30. A retractable stopper 46 more clearly shown in FIGS. 4 and 5 is fixed between the brackets 40. The stopper 46 can be retracted with the assistance of a handle 48 most clearly shown in FIG. 6. By retracting the stopper 46, the skid arm 42 can be manually turned to bring the skid arm 42 to a stowed position. The stowed position is as shown in FIG. 9.

A lug 50 engages with a counterpart lug 52 at a tip end of a skid 54 shown in FIG. 4. When the skid 54 is inverted into its stowed position, the lug 50 and the counterpart lug 52 hold the skid 54 and the skid arm 42 together in the stowed position as shown in FIG. 9.

Referring to FIG. 4, a stopper 56 controls an upper limit for the body 30 during transposition in the operational mode. When the body 30 is transposed, the stopper 56 mates with a second stopper 58 fixed on a beam 60. Therefore, during the operational mode, if the body 30 transposes, the body 30 is prevented from rotatably moving when the stopper 56 mates with the second stopper 58 on the beam 60 after allowing the required articulation of body 30.

Figure 9:
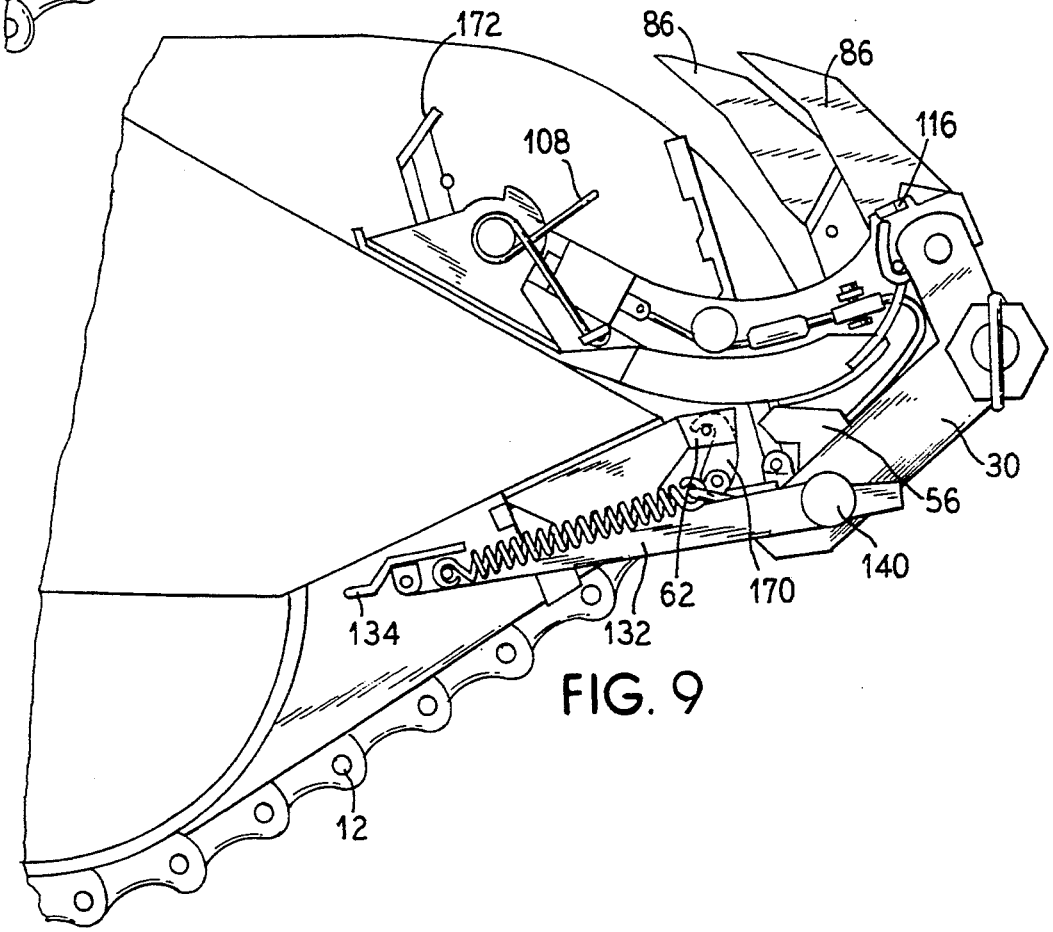
FIG. 9 illustrates a side view of an embodiment of the plow of the present invention in a stowed position.

In the stowed position as shown in FIG. 9, the upper portion of the stopper 56 controls maximum movement of the body 30. If the upper portion of the body 30 meets an embankment, the stopper 56 limits the maximum movement of the body 30 by resting on a counterpart member 62.

Referring again to FIG. 2, a ratchet 64 is illustrated. The ratchet 64 is pivoted on a pivot point 66. By pressing down on a handle 180, the ratchet 64 lifts and engages with a pin 68 fixed on the main beam 22. Engagement of the pin 68 on the main beam 22 stops any articulation between the body 30 and the main beam 22 particularly when the plow 14 requires manual lifting of the plow 14 upwardly.

Figure 3:
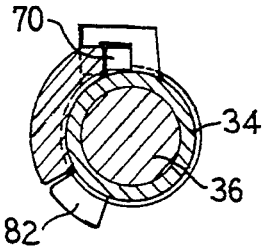
FIG. 3 illustrates a partial cross-sectional view of a bush and a shaft of the plow of the present invention.
Figure 2:
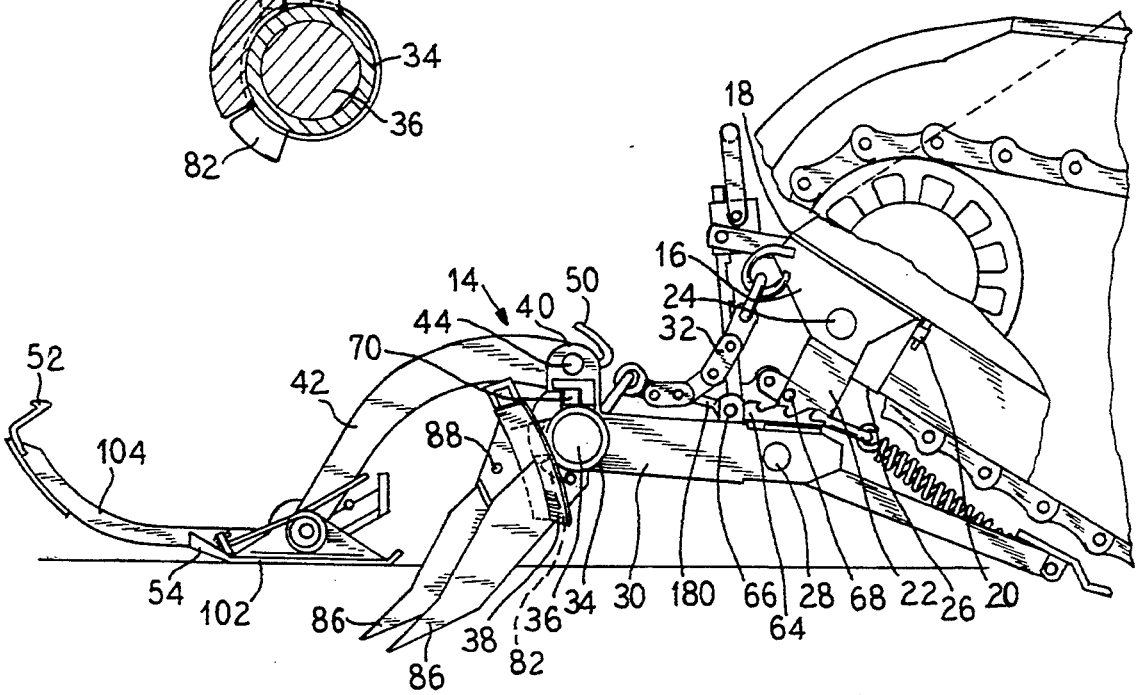
FIG. 2 illustrates a partial side view of components of an embodiment of the plow of the present invention.

A retractable stopper 70 is shown in FIGS. 2 and 3. The retractable stopper 70 is fixed on the bush 34. The stopper 70 can be retracted by pulling back a handle 72 shown in FIG. 6. Reference should also be made to FIG. 6 which shows a plan view of the plow 14 in an operating mode. By pulling back the handle 72, the stopper 70 is retracted and disengaged from a counterpart member 74. The counterpart member 74 is located on the tine assembly 38. Upon retracting of the stopper 70, the tine assembly 38 can be turned over pivot 36 to bring the assembly 38 into the stowed position as shown in FIG. 9.

The tine assembly 38 includes a main shaft 76 which extends through the bush 34. The bush 34 of the body 30 receives the main shaft 76 and secures its outer end with a large nut 78. The nut 78 has a bar 80 hinged thereon or otherwise secured such that the nut 78 can be unbolted from the main shaft 76 using, for example, a crow bar or a rod through the bar 80.

The stopper 74 engages with the retractable stopper 70 and prevents the tine assembly 38 from moving upwardly. The lower end of the stopper 74 engages with a fixed stopper 82 as shown in FIG. 3. The fixed stopper 82 is welded onto the bush 34 and prevents the tine assembly 38 from translationally moving beyond the stopper 82.

Referring again to FIG. 6, brackets 84 extend from the main shaft 76 to hold tines 86. Each of the tines 86 is fixed to the brackets 84 using rivets 88, one of which is shown in FIG. 2. Two rivets 88, however, are provided for each of the tines 86 for securing to each of the brackets 84. One of the rivets 88 is strong while a second rivet is weak. The rivets 88 act as a fuse such that if a tine 86 comes into contact with an underground obstacle during the operational mode, the weak rivet shears. As a result, the tine 86 rotates backwards on the stronger rivet 88. This prevents the tines 86 from breaking or damaging any part of the plow 14.

At a later more convenient time, the tine 86 can be pulled into its original position, and the sheared rivet can be replaced by a spare bolt 90. The tines 86 during the operational mode extract mines 92 as generally shown in FIG. 1 from the ground 94 through which the plow is passing. While three tines 86 are shown in the illustrated embodiments, the number of tines 86 may be varied depending on the width of the track 12 of the vehicle 10.

As most clearly shown in FIGS. 1 and 7, a blade 96 of the plow 14 moves the extracted mine 92 from the path of the track 12 of the vehicle 10. A fender 98 is further provided to prevent the extracted mine 92 from going over the blade 96 and into the track 12 especially during high speed operation of the vehicle 10.

Dummy tines 100 are provided to prevent the mines 92 from slipping between the tines 86 during operation of the plows 14. The dummy tines 100 are configured as shown such that the earth 94 may be slightly contacted by the dummy tines 100 but not fully penetrated as in the case of the tines 86.

Referring to FIG. 4, the skid 54 is implemented to control the depth of cut of the tine 86 through the earth 94. The skid 54 articulates along the earth 94 and moves the tines 86 accordingly.

The skid 54 consists of a base plate 102 which follows the undulations of the earth 94 or ground. An extension 104 of the skid 54 provides lift to the skid 54. A lift plate 106 is provided at a front portion of the extension 104 providing the lift in the extension 104 and, therefore, the skid 54.

The skid 54 overturns onto the skid arm 42 via an overturning spring 108. The skid 54 overturns onto the skid arm 42 whenever the plow 14 is lifted and the skid 54 is freed from the ground 94. The skid 54, in this manner, is pivoted to the skid arm 42. The articulation of the skid 54 is controlled by a first stopper 110 and a second stopper 114.

In the operational mode, the first stopper 110 controls an upper limit by resting against its counterpart 114. When crossing ditches or trenches, for example, the skid 54 articulates downward. The downward articulation is limited by the stopper 112 resting against arm 42. This particular configuration assists the skid in crossing ditches. When crossing deep ditches, skid 54 is freed from pressure exerted by ground 94. The overturning spring 108 is biased to fold the skid 54 back onto the skid arm 42, but the first stopper 110 and its counterpart 114 prevent the overturning spring 108 from folding the skid 54 back onto the skid arm 42. The skid extension 104, therefore, continues to extend forwardly to bridge the trench or ditch. When the extension 104 strikes a far end of a trench or ditch, the extension 104 assists the skid 54 in lifting the plow 14 from the ditch.

The skid arm 42 is pivoted at the point 44 with respect to the body 30 shown in FIG. 5. A rear end of the skid arm 42 rests on the retractable stopper 46. A small removable plate 116 most clearly shown in FIG. 9 can be removed to increase the depth of cut of the tines 86. By removing the plate 116, the space between the end of the skid arm 42 and the retractable stopper 46 is increased. The end of the skid arm 42, therefore, moves downward so as to move the forward end of the arm 42 upward. In turn, the skid 54 is lifted upwardly. The relationship between the base plate 102 of the skid 54 and the tines 86 changes so as to increase the depth of cut of the tines 86.

Referring again to FIG. 4, a skid lock 118 is fixed to a front end of the skid arm 42. In the operating mode, the counterpart retractable stopper 114 remains in the forward position as shown and controls the articulation of the skid 54 with the first stopper 110 assisting in ditch or trench crossing as previously set forth. After the mine clearing task is completed and the plow 14 is lifted from the ground 94, the overturning spring 108 turns the skid 54 and its extension 104 onto the skid arm 42. This is effected by the retractable counterpart stopper 114 pulling a small chain 120.

The small chain 120 is attached to the retractable counterpart stopper 114 at one end and to the main beam 22 at its other end with a bracket 122. When the plow 14 lifts upwardly, the angle between the main beam 22 and the body 30 increases. As a result, a pull is exerted on the chain 120 thereby retracting the stopper 114. This permits the overturning spring 108 to invert the skid 54 and extension 104 onto the skid arm 42. A turn-buckle 124 permits the chain 120 to be adjusted. Additional brackets 126 and 128 hold the chain 120 to the skid arm 42.

A lifting leg generally illustrated at 130 includes an arm 132, a base plate 134, a spring 136, and a dog 138. To lift the plow 14, the vehicle 10 is first reversed a few yards. The base plate 134 engages in the ground 94 turning the lifting leg 130 on a pivot 140. The engagement of the base plate 134 of the lifting leg 130 forces the pivot 140 to move forwards and upwards. The leg 130 is limited in its forward movement by a stopper 142. The stopper 142 rests on the stopper 58 when this forward limit is reached.

When the lifting leg 130 pivots about the pivot 140, the pivot 140 moves upward and forces the beam 60 to revolve on another pivot 144. When the beam 60 moves upward, the dog 138 moves along with the beam 60. The dog 138 has a pointed stopper 146 and a curved stopper 148 and is pivoted at a point 150 on the beam 60.

As the dog 138 moves upward along with the beam 60, the pointed stopper 146 strikes against a pin 152 which is fixed on the sliding bracket 16. After the stopper 146 strikes against the pin 152, the dog 138 is forced to turn on the pivot 150. A long arm of the dog 138 is attached to one end of a spring 154 as shown in FIG. 4. As the dog 138 rotates, the long arm of the dog 138 stretches the spring 154 to increase the tension in the spring 154.

After the vehicle 10 is reversed a few yards, the vehicle 10 moves forward again. The leg 130 is still engaged with the ground 94 and moves backwards until the leg 130 is completely released from the ground 94. Since the long arm of the dog 138 has built a tension in the spring 154, the spring 154 pulls the leg 130 up into a stowed position as shown in FIG. 9. As the dog 138 rotates and moves with the beam 60, the curved stopper 148 is positioned above the pin 152.

When the plow 14 is again dropped to the ground 94, the curved stopper 148 strike the pin 152 and forces the dog 138 to turn about its pivot 140. The long arm of the dog 138 also turns and releases the tension on the spring 154 of the leg 130. The lifting leg 130 thereby is allowed to drop to the ground due to its weight. The lifting leg 130 then follows the plow 14. The leg 130, therefore, is prepared for lifting whenever the vehicle 10 is reversed.

If the plow 14 requires discarding, a catch 20 (shown in FIG. 4) may be manually disengaged. The vehicle 10 then is reversed engaging the base plate 134 of the lifting leg 130 in the ground 94. The leg 130 then pushes the sliding bracket 16 forward off its female part 18 thereby discarding the plow 14 from the vehicle 10.

Figures 10, 11:
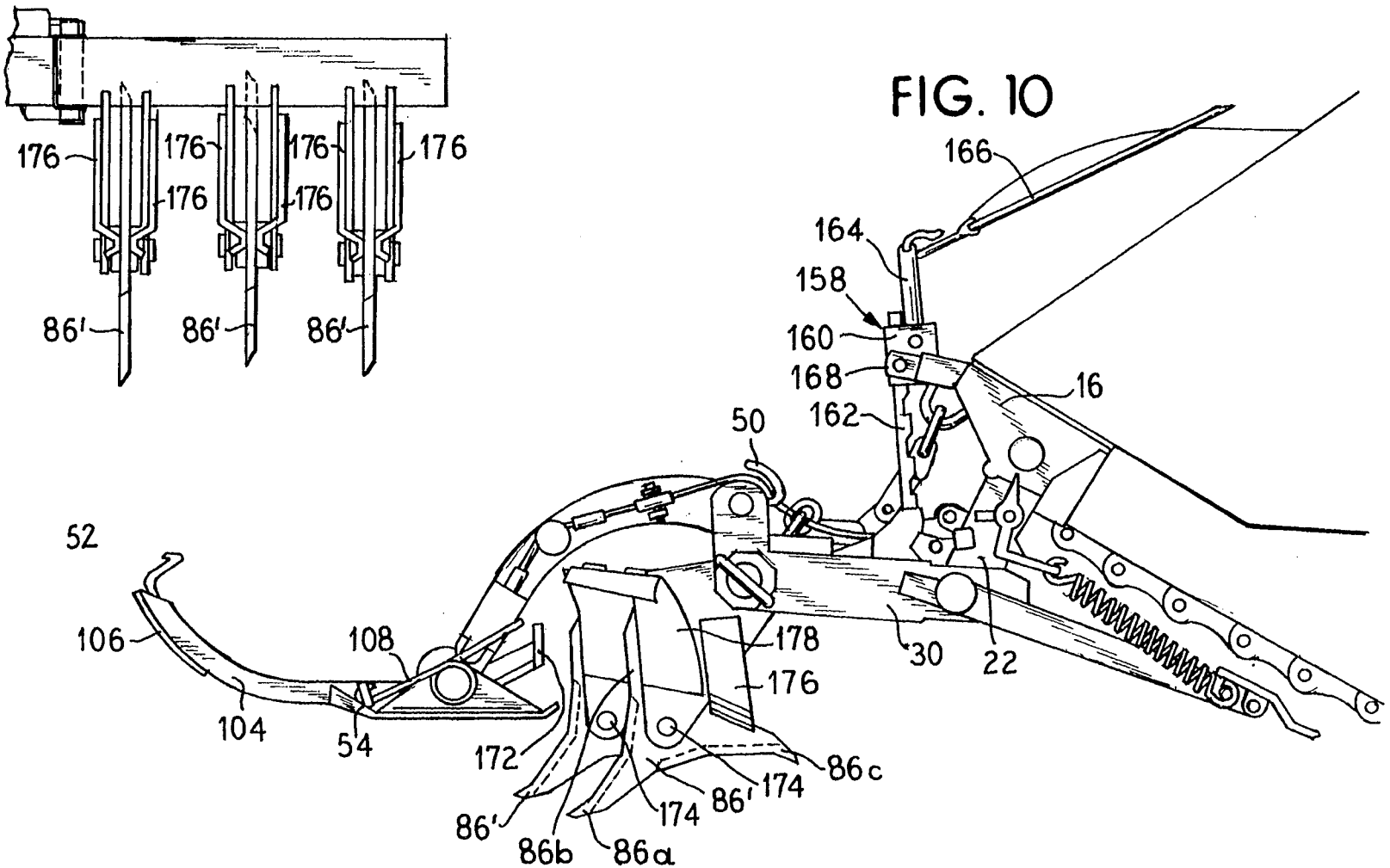
FIG. 10 illustrates a side view of another embodiment of a plow of the present invention.
FIG. 11 illustrates a partial front view of the embodiment of the plow of the present invention as illustrated in FIG. 10.

Referring now to FIG. 10, a locking assembly is generally shown at 158. The locking assembly 158 includes a box 160, a ratchet arm 162 having three ratchets, a releasing handle 164 and a cable 166. The box 160 is pivoted on two brackets, one of which is shown at 168. The brackets 168 are fixed to the sliding bracket 16. Whenever the plow 14 is lifted upwardly, either manually or by its lifting leg 130, as when the vehicle 10 is reversed, the lower end of the main beam 22 also moves forwards and upwards. The ratchet arm 162 is pivoted to the lower end of the beam 22 at numeral 156 (more clearly visible in FIG. 8) and also moves upward.

As the ratchet arm 162 moves up through the box 160, a spring-loaded catch (not shown) located inside the box 160 engages with the ratchets on the ratchet arm 162. The height to which the leg 130 lifts the plow 14 depends on the particular soil of the ground 94. In hard-type ground, the leg 130 lifts to the maximum height thereby engaging the third ratchet of the ratchet arm 162. In softer ground, such as sand, the leg 130 sinks into the ground 94 and engages the first ratchet of the ratchet arm 162.

Any one of the three ratchets of the ratchet arm 162 may engage such that the tines 86 of the plow 14 disengage from the ground 94 and the vehicle 10 can continue unhindered by the plow 14. At a later time, if the plow is not fully lifted, the plow 14 may be lifted by reversing the vehicle 10 on hard ground or manually engaging the third ratchet of the ratchet arm 162.

The releasing handle 164 is connected to a cable 166 leading into the driver's cabin. A handle (not shown) at the opposite end of the cable 166 is located inside the cabin. To release the plow 14, the driver pulls the handle which pulls the cable 166 and the releasing handle 164. This action pulls the catch inside the box 160 thereby releasing the ratchet arm 162. The plow 14 falls to the ground 94 with its own weight.

Figure 8:
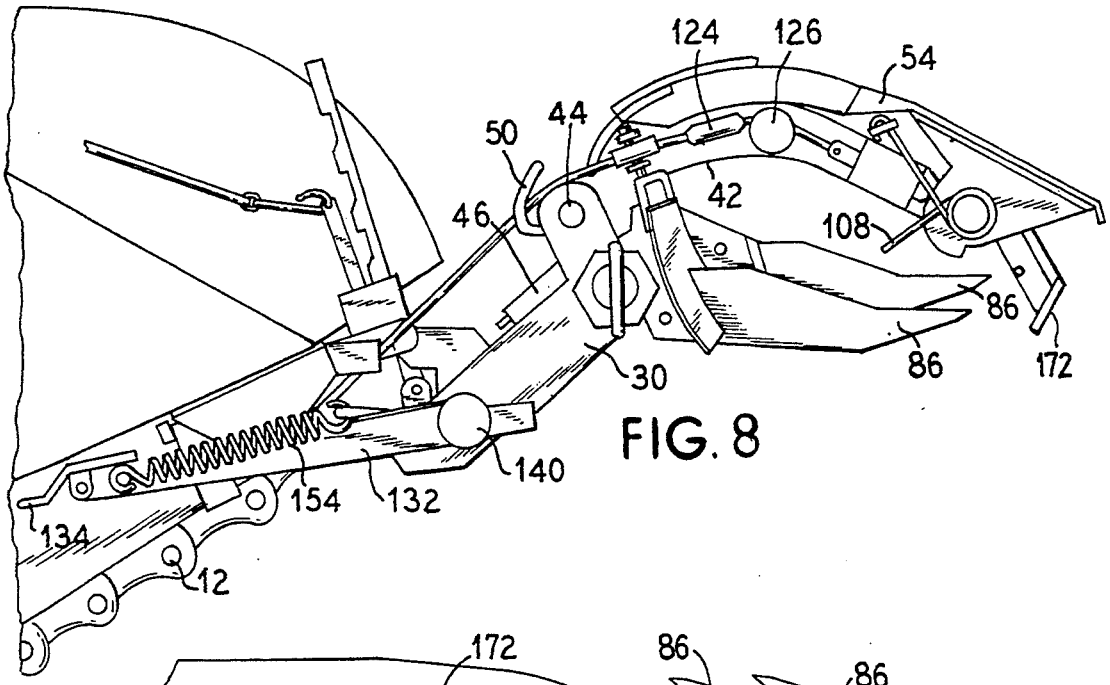
FIG. 8 illustrates a side view of an embodiment of the plow of the present invention in a pre-operational mode.

Operation of the plow 14 generally occurs as follows with reference to all of the figures. The plow 14 is normally stowed in the position illustrated in FIG. 9. Whenever a mine clearing operation is anticipated, the plow 14 is brought to a pre-operation mode as shown in FIG. 8. To bring the plow into the pre-operation mode, the skid 54 is lifted and turned manually to the front. Handle 72 is then pulled, and the tine assembly 38 is rotated manually such that the tines 86 point to the front. The plow 14 is then lifted a few inches to release a safety hook 170 as shown in FIG. 9. The safety hook 170 is spring loaded and disengages by itself. The load of the plow 14 is then controlled by the locking assembly 158.

The plow 14 remains in the pre-operation mode until the vehicle 10 arrives at a mine field. Here the driver, pulls a handle in the cabin to release the plow 14. The plow 14 falls to the ground 94 with its own weight. On hitting the ground 94, a lug 172 as shown in FIG. 8 digs into the ground 94. When the vehicle 10 moves forward, the lug 172 forces the skid 54 to overturn on its pivot owing to pressure against ground 94 and to unfold it into the operating mode.

The operating mode is generally illustrated in FIGS. 2, 4, 7 and 10. As the vehicle 10 moves in a forward direction, the tines 86 dig into the ground 94. The skid 54 controls the depth of cut and moves the plow 14 so as to follow the undulations in the ground 94. The tines 86 extract the mines 92 from the ground 94 which are subsequently moved out and away from the path of the treads 12 of the vehicle 10 by the blade 96.

After completing a mine removal operation in the operating mode, that is, when the vehicle 10 reaches the far end of the mine field, the vehicle 10 reverses to lift the plow 14 back into the pre-operation mode. To do so, the base plate 134 of the lifting leg 130 engages in the ground 94 forcing the plow 14 into the position of the pre-operation mode. The locking assembly 158 holds the plow 14 in the lifted position. The vehicle 10 may then continue on its mission without the plow 14 interfering with its movement.

After the vehicle 10 has completed its particular mission and as the particular situation in the field permits, the plow 14 is restored to its stowed position manually. First, the plow 14 is lifted a few inches and the safety hook 170 is applied manually as shown in FIG. 9. After pulling the release handle 48, most clearly shown in FIG. 6, the skid 54 is overturned and placed on the body of the vehicle 10. Finally, after pulling the handle 72, the tine assembly 38 is turned over the mud guard covering the tracks 12 of the vehicle 10.

An alternative embodiment of the plow 14 is illustrated in FIG. 10. The fixed tines 86 of the other embodiments may be replaced with star-shaped revolving tines 86'. The star-shaped revolving tines 86' each include three blades **86*a*, 86*b* and 86*c*. Each of the tines 86' turns on a pivot 174. When a first blade, for example, the blade 86*a*, strikes an underground obstacle, such as an immovable stone, the tine 86' turns on its pivot 174. The next blade 86*b* takes over and starts digging. The rotation of the tine 86' is possible since the blade 86*a*** is pushed back by an immovable obstacle or by unplowed ground.

During normal plowing, the blades **86*a*, 86*b* and 86*c* are prevented from rotating by two flexible plates generally shown at 176 in FIGS. 10 and 11. The blade 86*c* can only pass between the plates 176 if the blade 86*a* is forced back by an immovable obstacle. The fender 98 previously described with reference to the first embodiment of the tine assembly 38 is replaced by a folding extension generally illustrated at 178 in FIG. 10. The extension 178 lifts upwardly with the force of the ground 94 or the mine 92 or other obstacle thereby extending the blade upward and preventing the mine 92 from going over the top of the extension 178**.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An apparatus connected to a vehicle having a plurality of tracks for removing obstacles in a path of the plurality of tracks of the vehicle in an operational mode from an area of land, the apparatus comprising:

a penetrating member at least partially penetrating into the land in the operational mode, the penetrating member preceding only each of the plurality of tracks; and a tracking member associated with each of the penetrating members, She tracking member substantially following a surface of the land in the operational mode and constructed and arranged to substantially maintain penetration of the penetrating member into the land wherein the vehicle pushes the tracking member and the penetrating member across at least a portion of the land to remove the obstacles from the path of the tracks of the vehicle.

2. The apparatus of claim 1 wherein the penetrating member is a tine angularly displaced with respect to the land.

3. The apparatus of claim 1 wherein the tracking member and the penetrating member are operatively connected at a pivot point to mechanically rotate into a stowed position.

4. The apparatus of claim 1 wherein the penetrating member is operatively connected at a pivot point to mechanically rotate into a pre-operational position.

5. The apparatus of claim 1 wherein the penetrating member is a rotatable tine having a plurality of blades.

6. The apparatus of claim 1 further comprising:

a deflector constructed and arranged to prevent the obstacles from situating in the path of the tracks of the vehicle after removal from the land.

7. The apparatus of claim 1 further comprising:

means for inverting the penetrating member and the tracking member into a pre-operational mode such that the apparatus cannot interfere with movement of the vehicle.

8. The apparatus of claim 1 wherein the vehicle is armored.

9. A plowing apparatus for attachment to a vehicle having a plurality of tracks for removing obstacles from an area of land in a path of the plurality of tracks of the vehicle, the apparatus comprising:

a plurality of plowing members, each of the plurality of plowing members including a plurality of tines for penetrating the land, the plurality of plowing members preceding only the plurality of tracks; and a plurality of tracking members corresponding to the plurality of plowing members wherein each of the plurality of tracking members follows contours in the land and are constructed and arranged to substantially maintain a depth of penetration of the land by the plurality of tracking members.

10. The plowing apparatus of claim 9 further comprising:

adjusting means for varying the depth of the penetration of each of the plurality of tines.

11. The plowing apparatus of claim 9 further comprising:

a handle operatively connected to release the apparatus from a pre-operational mode to the land.

12. The plowing apparatus of claim 9 wherein each of the plurality of tracking members comprises:

a skid substantially following the contours of the land; and a skid arm connected to the skid to adjust the depth of penetration of the associated plurality of tines as the skid crosses the contours.

13. The apparatus of claim 9 wherein the plurality of tines are angled with respect to the land having a horizontal displacement between each of the plurality of tines.

14. The apparatus of claim 9 wherein the plurality of tines are rotatable and each of the plurality of tines includes a plurality of blades.

15. The apparatus of claim 9 wherein the vehicle is armored having two tracks for moving the vehicle across the land wherein the plurality of plowing members is two and the plowing members immediately precede the tracks of the vehicle in an operational mode.

16. A method for removing obstacles from an area of land, the method comprising the steps of:

providing a vehicle having a plurality of tracks for traveling across at least a portion of the area of land;

securing a plurality of land penetrating members to the vehicle such that the land penetrating members extend in front of only the plurality of tracks;

providing at least one tracking member for substantially maintaining a depth of penetration of the plurality of land penetrating members; and moving the vehicle across the portion of the area of the land.

17. The method of claim 16 further comprising the step of:

stowing at least the plurality of land penetrating members in a position to not interfere with operation of the vehicle.

18. The method of claim 16 further comprising the step of:

mechanically positioning at least the plurality of land penetrating members between a stowed position, a pre-operational position and an operational position.

19. The method of claim 16 further comprising the step of:

mechanically positioning the at least one tracking member.

20. An apparatus connected to a vehicle having a plurality of tracks for removing obstacles in a path of the plurality of tracks of the vehicle in an operational mode from an area of land, the apparatus comprising:

a penetrating member at least partially penetrating into the land in the operational mode; and a tracking member associated with the penetrating member, the tracking member substantially following a surface of the land in the operational mode and constructed and arranged to substantially maintain penetration of the at least one member into the land wherein the vehicle pushes the tracking member and the at least one member across at least a portion of the land to remove the obstacles wherein the penetrating member is a rotatable tine having a plurality of blades.

21. A plowing apparatus for attachment to a vehicle having a plurality of tracks for removing obstacles from an area of land in a path of the plurality of tracks of the vehicle, the apparatus comprising:

a plurality of plowing members, each of the plurality of plowing members including a plurality of tines for penetrating the land; and a plurality of tracking members corresponding to the plurality of plowing members wherein each of the plurality of tracking members follows contours in the land and are constructed and arranged to substantially maintain a depth of penetration of the land by the plurality of tracking members wherein the plurality of tines are rotatable and each of the plurality of tines includes a plurality of blades.

22. A method for removing obstacles from an area of land, the method comprising the steps of:

providing a vehicle having a plurality of tracks for traveling across at least a portion of the area of land;

securing a plurality of land perpetrating members each member having a penetrating end to the vehicle such that the hand penetrating members extend in front of the vehicle;

providing at least one tracking member for substantially maintaining a depth of penetration of the penetrating ends of the plurality of land penetrating members;

moving the vehicle across the portion of the area of the land;

positioning at least the plurality of land penetrating members between a stowed position, a pre-operational position and an operational position; and inverting the plurality of land penetrating members into the stowed position such that the penetrating ends of the land penetrating members are directed toward the vehicle.

* * * * *